US010741026B2

(12) United States Patent
Unnerstall

(10) Patent No.: US 10,741,026 B2
(45) Date of Patent: Aug. 11, 2020

(54) SYSTEMS AND METHODS FOR PROVIDING AUGMENTED REALITY EXPERIENCES

(71) Applicant: MASTERCARD INTERNATIONAL INCORPORATED, Purchase, NY (US)

(72) Inventor: Rick Unnerstall, O'Fallon, MO (US)

(73) Assignee: MASTERCARD INTERNATIONAL INCORPORATED, Purchase, NY (US)

( * ) Notice: Subject to any disclaimer, the term of this patent is extended or adjusted under 35 U.S.C. 154(b) by 63 days.

(21) Appl. No.: 16/114,874

(22) Filed: Aug. 28, 2018

(65) Prior Publication Data

US 2020/0074808 A1 Mar. 5, 2020

(51) Int. Cl.
*G07F 17/32* (2006.01)

(52) U.S. Cl.
CPC ..... *G07F 17/3288* (2013.01); *G07F 17/3211* (2013.01)

(58) Field of Classification Search
CPC ... G07F 17/32; G07F 17/3211; G07F 17/3288
See application file for complete search history.

(56) References Cited

U.S. PATENT DOCUMENTS

2012/0184352 A1* 7/2012 Detlefsen ..... G07F 17/3225 463/25
2019/0362601 A1* 11/2019 Kline ..... G07F 17/3288

* cited by examiner

*Primary Examiner* — Jasson H Yoo
(74) *Attorney, Agent, or Firm* — Harness, Dickey & Pierce, P.L.C.

(57) ABSTRACT

Systems and methods herein relate to augmented reality (AR) experiences for users. One exemplary method includes determining whether a computing device, associated with a user, is within a wagering area for an event and, when the computing device is within the wagering area, accessing an event record from a wagering hub for the event. The event record includes an offer for a wager from an originating user within the wagering area. The method also includes providing an AR experience to the user including a symbol for the offer for the wager included in the event record, where the symbol includes at least one detail of the wager, and transmitting an acceptance of the offer for the wager to the wagering hub based on an input, by the user, directed to the offer in the AR experience.

20 Claims, 5 Drawing Sheets

SYSTEMS AND METHODS FOR PROVIDING AUGMENTED REALITY EXPERIENCES

FIELD

The present disclosure generally relates to systems and methods for providing augmented reality (AR) experiences, and in particular, to systems and methods for use in providing AR experiences to users in connection with interactions by the users at various different events.

BACKGROUND

This section provides background information related to the present disclosure which is not necessarily prior art.

Wagering on events, including sporting events, is known. In general, sports booking firms identify events such as games, races, etc., and define wagers for the events. Often, the wagers are associated with "odds" of who is favored to win the events, whereby users may then make selections of winners of the events as part of their wagers, for example, based on the odds. The odds are typically set or determined based on ratios between amounts staked by the users to their wagers for the events. So, for example, where the odds are 3 to 1 that a certain team will win an event (or game), a user's wager of $10 on that team would yield $30 if that team wins. Beyond selecting winners/losers, the wagers may also account for spreads, whereby a point spread may be combined with the odds of either of two teams winning to then make the odds of either team winning generally equal, or not.

It is also known for users to wager funds in person at the sports booking firms (at locations included in casinos in Las Vegas, Nevada, for example) or online through various gambling websites. When wagers are placed online, the users will generally be associated with accounts having at least some funds therein from which the users make wagers on events. Funds are then generally subtracted from the accounts upon the wagers being submitted (and held by the booking firm), with winnings being paid back into the accounts.

DRAWINGS

The drawings described herein are for illustrative purposes only of selected embodiments and not all possible implementations, and are not intended to limit the scope of the present disclosure.

Figure 1:
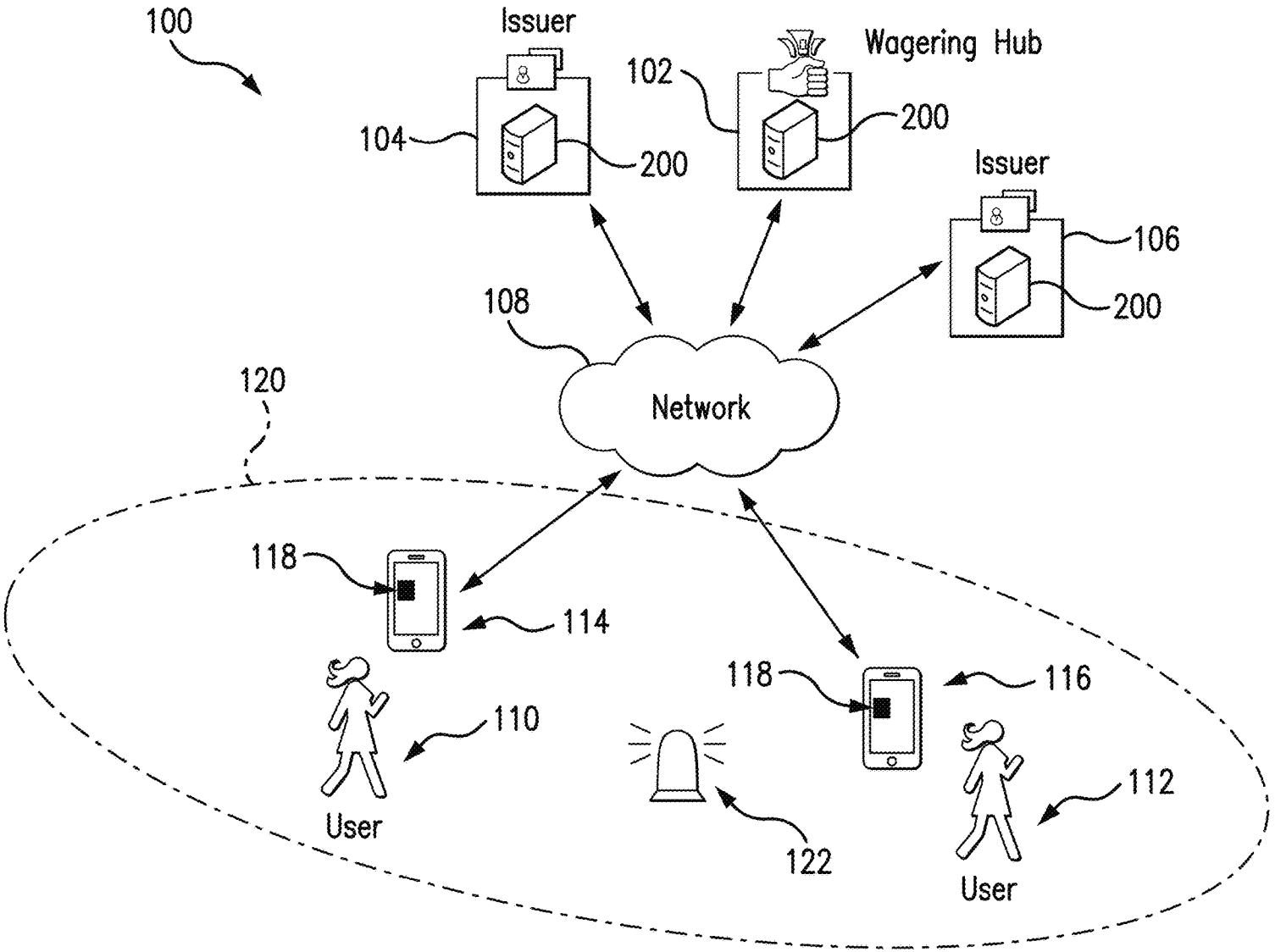
FIG. 1 is an exemplary system of the present disclosure suitable for use in providing augment reality (AR) experiences to users in connection with wagering by the users in connection with various events.
Figure 3:
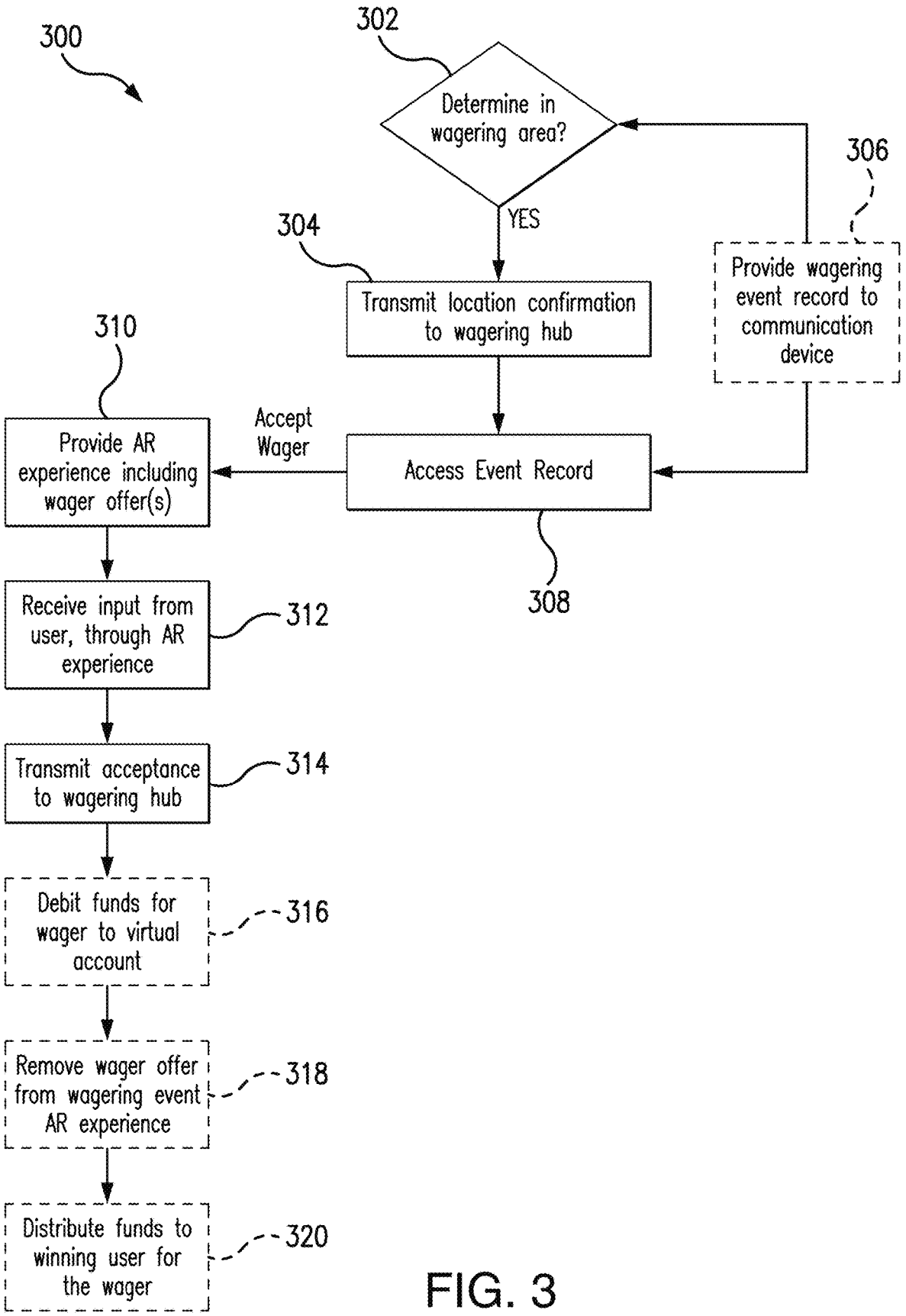
FIG. 3 is an exemplary method that may be implemented in the system of FIG. 1 for use in providing an AR experiences to a user, when in a wagering area, to permit the user to wager on an event.
Figure 4:
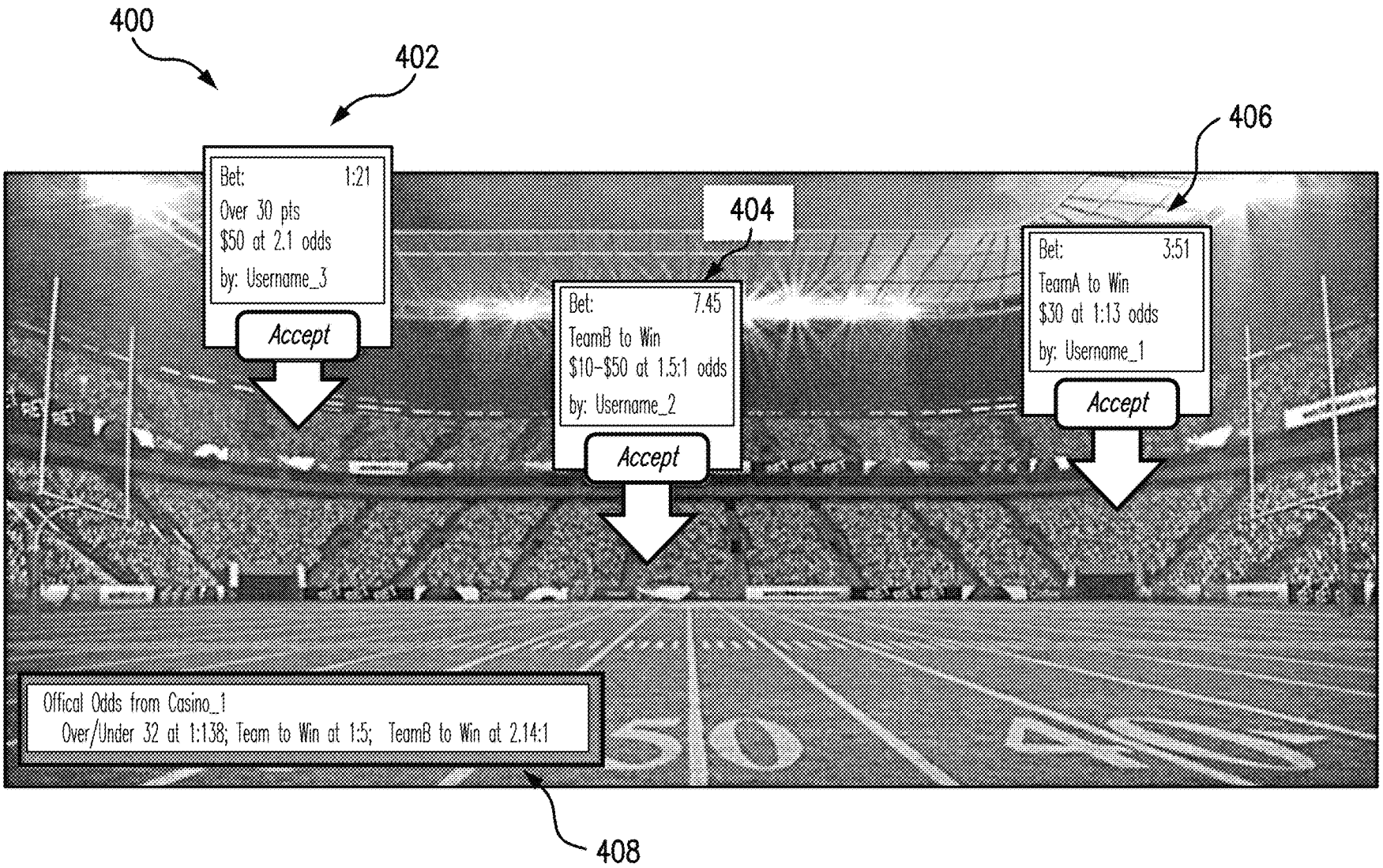
Figure 5:
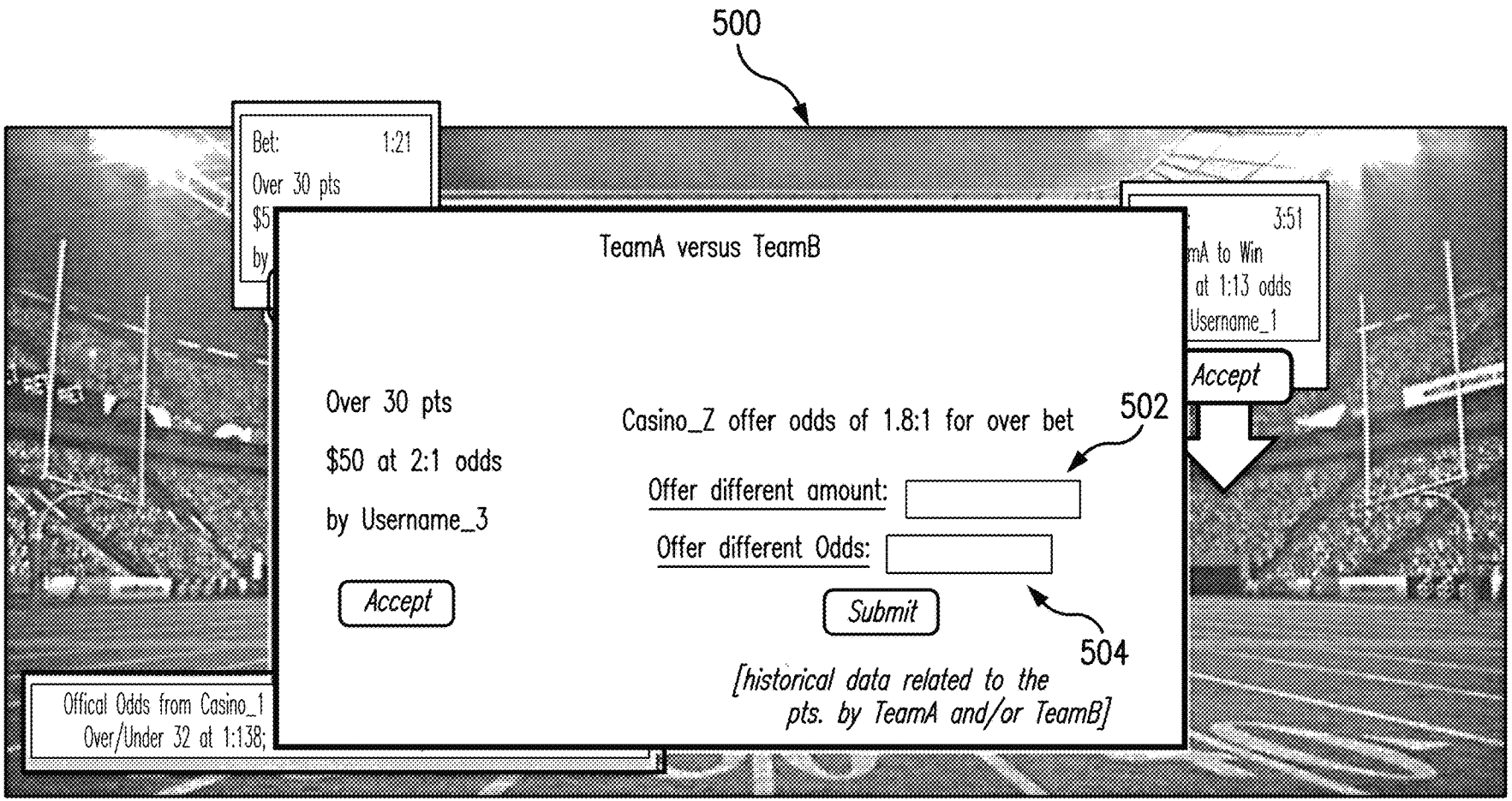

FIG. 4 is an exemplary AR interface that may be displayed to a user in connection with the system of FIG. 1 and/or the method of FIG. 3, where the interface includes an AR view and multiple available wagers and may be used by the user to accept one or more of the available wagers; and FIG. 5 is an exemplary wager interface that may be displayed to the user, over the AR interface of FIG. 4, in connection with the system of FIG. 1 and/or the method of FIG. 3.

Corresponding reference numerals indicate corresponding parts throughout the several views of the drawings.

DETAILED DESCRIPTION

Exemplary embodiments will now be described more fully with reference to the accompanying drawings. The description and specific examples included herein are intended for purposes of illustration only and are not intended to limit the scope of the present disclosure.

Wagering may be limited by certain locations (e.g., through applicable laws, regulations, restrictions, etc.), or by user preferences, or otherwise. In connection therewith, booking firms may include physical locations at, for example, casinos, race tracks, etc., whereby users are able to bet against the "house" according to odds, spreads, etc. set by the booking firms. In addition, online booking firms provide network-accessible platforms (e.g., websites, mobile applications, etc.) to users, whereby the users are able to wager against the "house" at virtually any location, again at the odds, spreads, etc. set by the booking firms. In such conventional applications, though, the users are generally limited to the odds, spreads, etc. set by the booking firms, as to the wagers, and to the booking firms as the other participant in the wagers.

Uniquely, the systems and methods herein permit users to view and engage in wagering, within wagering areas, through augmented reality (AR) experiences at the wagering areas. In particular, a wagering application cooperates with a wagering hub to determine when a user is within a wagering area. When within the wagering area, in various embodiments, the user is permitted to explore an AR experience, which is set at the wagering area (e.g., a sports stadium, etc.) to locate and evaluate offers for wagers for an event submitted by other users at the event (or potentially, the wagering hub). The user is permitted to accept the wager offers through the AR experience, whereupon funds indicated by the wagers are debited from an account associated with the user, and from an account of an originating user offering the wager. A virtual account is created, and the funds are posted to the virtual account, and then distributed, by the wagering hub, from the virtual account to the winner of the users. In this manner, the AR experience offers a user-to-user wagering platform, which provides gamification of the wagering and/or the event, whereby an improved interface for wager offers is provided to make the user's experience more efficient and/or entertaining (e.g., in the fields of commerce and augmented reality, etc.).

FIG. 1 illustrates an exemplary system 100 in which one or more aspects of the present disclosure may be implemented. Although the system 100 is presented in one arrangement, other embodiments may include systems arranged otherwise depending, for example, on processing of wagering transactions, types of wagers, types of events associated with the wagers (e.g. sports events, entertainment events, national events, political events, etc.), locations of wagering areas, AR experiences, privacy concerns, etc.

In the illustrated embodiment, the system 100 generally includes a wagering hub 102 and two issuers 104 and 106, each coupled to (and in communication with) a network 108. The network 108 may include, without limitation, a local area network (LAN), a wide area network (WAN) (e.g., the Internet, etc.), a mobile network, a virtual network, and/or another suitable public and/or private network capable of supporting communication among two or more of the parts illustrated in FIG. 1, or any combination thereof. For example, network 108 may include multiple different networks, such as a private payment transaction network made accessible by the wagering hub 102 to the issuers 104 and 106, and, separately, the public Internet, which is accessible as desired to multiple users, such as users 110 and 112, via communication devices 114 and 116, respectively, to communicate with the wagering hub 102, etc.

The wagering hub 102 in the system 100 is generally included as a wagering platform for the users 110 and 112 (and other users), whereby the users 110 and 112 are permitted to engage in wagering, through AR, with one another. The wagering hub 102 may be a standalone entity in the system 100, or it may be included in another entity, such as, for example, a payment network, whereby fund transfers associated with the wagering may be facilitated thereby. The wagering hub 102 is configured, as described below, to communicate and/or interact with wagering applications 118 installed at each of the communication devices 114 and 116, again, as described in more detail below.

The issuers 104 and 106 in the system 100 are banking institutions, whereby the issuers 104 and 106 offer financial products to the users 110 and 112 (and other users), including, without limitation accounts, or more specifically, payment accounts, etc. The accounts may include, without limitation, credit accounts, debit accounts, prepaid accounts, checking accounts, savings accounts, etc. In this exemplary embodiment, the issuer 104 has issued a payment account to the user 110, while the issuer 106 has issued a payment account to the user 112.

As indicated above, the users 110 and 112 are associated with the communication devices 114 and 116, respectively. And, each of the communication devices 114 and 116 includes the wagering application 118 installed thereon (e.g., as installed by the users 110 and 112, etc.). With that said, the communication devices 114 and 116 may include smartphones, tablets or other suitable communication devices. The communication devices 114 and 116, in this example embodiment, are portable communication devices, whereby they are permitted and/or useable by the users 110 and 112, as the users 110 and 112 travel from location to location.

While one wagering hub 102, two issuers 104 and 106, two users 110 and 112, and two communication devices 114 and 116 are included in the system 100 illustrated in FIG. 1, it should be appreciated that any number of these entities, devices, and/or persons (and their associated components) may be included in the system 100, or may be included as a part of systems in other embodiments, consistent with the present disclosure.

Figure 2:
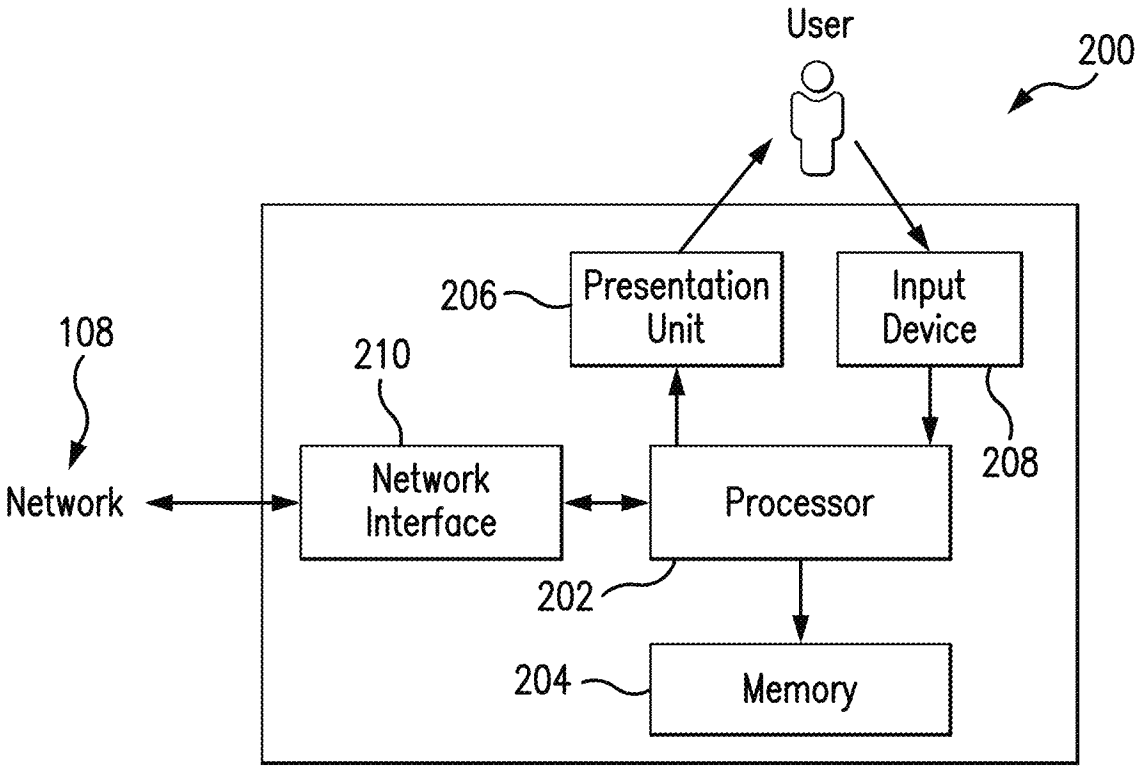
FIG. 2 is a block diagram of a computing device that may be used in the exemplary system of FIG. 1.

FIG. 2 illustrates an exemplary computing device 200 that can be used in the system 100. The computing device 200 may include, for example, one or more servers, workstations, personal computers, laptops, tablets, smartphones, etc. In addition, the computing device 200 may include a single computing device, or it may include multiple computing devices located in close proximity or distributed over a geographic region, so long as the computing devices are specifically configured to function as described herein. In particular, in the exemplary system 100 of FIG. 1, each of the wagering hub 102 and the issuers 104 and 106 are illustrated as including, or being implemented in, computing device 200, coupled to the network 108. In addition, the communication devices 114 and 116 may each be considered a computing device consistent with computing device 200. That said, the system 100 should not be considered to be limited to the computing device 200, as described below, as different computing devices and/or arrangements of computing devices may be used. In addition, different components and/or arrangements of components may be used in other computing devices.

Referring to FIG. 2, the exemplary computing device 200 includes a processor 202 and a memory 204 coupled to (and in communication with) the processor 202. The processor 202 may include one or more processing units (e.g., in a multi-core configuration, etc.). For example, the processor 202 may include, without limitation, a central processing unit (CPU), a microcontroller, a reduced instruction set computer (RISC) processor, an application specific integrated circuit (ASIC), a programmable logic device (PLD), a gate array, and/or any other circuit or processor capable of the functions described herein.

The memory 204, as described herein, is one or more devices that permit data, instructions, etc., to be stored therein and retrieved therefrom. The memory 204 may include one or more computer-readable storage media, such as, without limitation, dynamic random access memory (DRAM), static random access memory (SRAM), read only memory (ROM), erasable programmable read only memory (EPROM), solid state devices, flash drives, CD-ROMs, thumb drives, floppy disks, tapes, hard disks, and/or any other type of volatile or nonvolatile physical or tangible computer-readable media. The memory 204 may be configured to store, without limitation, transaction data, wager details (e.g., dollar values or ranges, overs, unders, first half points, second half points, total points, expiration times, other odds, etc.), accepted wager criteria, user profiles, and/or other types of data (and/or data structures) suitable for use as described herein. Furthermore, in various embodiments, computer-executable instructions (as generally described herein) may be stored in the memory 204 for execution by the processor 202 to cause the processor 202 to perform one or more of the functions described herein, such that the memory 204 is a physical, tangible, and non-transitory computer readable storage media. Such instructions often improve the efficiencies and/or performance of the processor 202 that is performing one or more of the various operations herein. It should be appreciated that the memory 204 may include a variety of different memories, each implemented in one or more of the functions or processes described herein.

In addition in the exemplary embodiment, the computing device 200 includes a presentation unit 206 that is coupled to (and is in communication with) the processor 202 (however, it should be appreciated that the computing device 200 could include output devices other than the presentation unit 206, etc.). The presentation unit 206 outputs information (e.g., offers for wagers, symbols, AR experiences, etc.), either visually or audibly, to a user of the computing device 200, for example, the user 110 or the user 112 in the system 100, etc. Various interfaces (e.g., as defined by network-based applications, etc.) may be displayed at computing device 200, and in particular at presentation unit 206, to display such information. The presentation unit 206 may include, without limitation, a liquid crystal display (LCD), a light-emitting diode (LED) display, an organic LED (OLED) display, an "electronic ink" display, speakers, etc. In some embodiments, presentation unit 206 may include multiple devices. Further, the computing device 200 includes an input device 208 that receives inputs from the user (i.e., user inputs) such as, for example, a selection of a wager to accept, search criteria, etc. The input device 208 is coupled to (and is in communication with) the processor 202 and may include, for example, a keyboard, a pointing device, a mouse, a camera, a touch sensitive panel (e.g., a touch pad or a touch screen, etc.), another computing device, and/or an audio input device. Further, in various exemplary embodiments, a touch screen, such as that included in a tablet, a smartphone, or similar device, may behave as both the presentation unit 206 and the input device 208.

In addition, the illustrated computing device 200 also includes a network interface 210 coupled to (and in communication with) the processor 202 and the memory 204. The network interface 210 may include, without limitation, a wired network adapter, a wireless network adapter (e.g., a near field communication (NFC) adapter, a Bluetooth adapter, etc.), a mobile network adapter, or other device capable of communicating to/with one or more different networks, including the network 108. Further, in some exemplary embodiments, the computing device 200 may include the processor 202 and one or more network interfaces (including the network interface 210) incorporated into or with the processor 202.

Referring again to FIG. 1, the wagering hub 102 of the system 100 is associated with multiple different wagering events and/or multiple wagering areas. The wagering events may be sporting events, entertainment events, national events, political events, or other events, which each include one or more uncertain outcomes, whereby users may wager or "bet" funds on the outcomes of the events. In FIG. 1, a wagering area 120 is illustrated, which is associated with a wagering event. In this exemplary embodiment, the wagering event is a sporting event, and the wagering area 120 is centered on and/or includes a stadium, park, track, field, etc., where the sporting event is being held. The wagering area 120 may be defined by a geo-fence, such that a definition of the area 120 is provided in terms of location, or the wagering area 120 may be defined by a wireless network at the wagering area 120, as defined by beacons (e.g., dedicated beacons, routers, or other wireless devices, etc.), etc. The sporting event is known to the wagering hub 102, as is the wagering area 120. The wagering hub 102 also includes a data structure, which includes multiple wagering event records, and where each of the records includes a date, time, description, etc. of the event, and also, potentially, a geo-fence definition of the event, which is the wagering area 120 for the event. Upon request by an event coordinator, for example, or upon knowledge of the event, the wagering hub 102 creates and stores a wagering record in the data structure.

It should be appreciated that the wagering event may include the time or the event itself, and a period of time prior to the event (e.g., hours, days, or weeks, etc.), i.e., a wagering interval for the event, wherein wagers may be made. In addition, wagering areas may overlap with the site of the event, in whole or in part. Additionally, or alternatively, one or more wagering area(s) for an event may not overlap with the event and/or be remote from the event, whereby there may be one or multiple wagering areas for a single event, etc.

Furthermore, it should be appreciated that the wagering hub 102 will include and store wagering event records for multiple different events at any given time. In connection therewith, the wagering hub 102 is configured, by executable instructions, to receive information from a user or entity associated with the event (e.g., an event coordinator, etc.) or other user or entity, to generate the wagering event record for the event, and to store the wagering event record in the data structure (e.g., in the memory 204 of the computing device 200 associated with the wagering hub 102, etc.).

In addition, the users 110 and 112 each have a wagering account with the wagering hub 102, which includes a user profile for the users 110 and 112. Each of the user profiles includes the payment account issued to the respective one of the users 110 and 112 by issuers 104 and 106, to enable payment account transactions to be initiated through the wagering application 118, in response to a wager from the users 110 and/or 112. The user profiles may also each include and/or be associated with a username, name, and identifier associated with the corresponding user, which may be published with offers for wagers to the AR experiences to identify, to an extent, originating users associated with the offers.

Then, during a wagering interval for the event associated with the wagering area 120, the users 110 and 112 (and their communication devices 116 and 118) travel to the wagering area 120 (e.g., attend the sporting event). In connection therewith, or separately, the communication device 114 associated with the user 110 is configured, by the wagering application 118, to receive or retrieve wagering opportunities from the wagering hub 102. In particular, for example, the communication device 114 may be configured, by the wagering application 118, to solicit search criteria from the user 110, provide the search criteria from the user 110 to the wagering hub 102, and present wagering event records, in whole or in part, from the wagering hub 102 to the user 110, which are consistent with the search criteria. Additionally, or alternatively, the communication device 114 may be configured, by the wagering application 118, to provide location information for the communication device 114 to the wagering hub 102, which identifies event record(s) based on the location information (e.g., a location indicated by GPS coordinates, etc.) and then transmits the event record(s) to the communication device 114. In turn, then, the communication device 114 is configured to present wagering event records, in whole or in part, to the user 110, when received from the wagering hub 102. Additionally, the wagering hub 102 is configured to also receive search criteria and/or location information from the communication device 116 associated with the user 112, to search for and/or identify event record(s) consistent with the search criteria or location information, and to transmit or return wagering event records, in whole or in part, to the communication device 116 (or potentially the communication device 114).

Prior to, or after receipt of the wagering records, the user 110, for example, will enter into the wagering area 120. After entry into the wagering area 120, the communication device 114 is configured to determine the communication device 114 is within the wagering area 120, either by detecting a location relative to a geo-fence defining the wagering area 120, or by connectivity to a device (e.g., a beacon, etc.) which defines the wagering area 120. In the later, for example, as shown in the illustrated system 100 of FIG. 1, a beacon computing device (or beacon) 122 is present in the wagering area 120. The beacon 122 may include a dedicated computing device specific to defining the wagering area 120, or it may include, for example, a wireless router, which provides a wireless network, associated with the wagering area 120. When the user 110 enters the wagering area, then, the communication device 114 is configured to detect the beacon 122, by a wireless signal emitted therefrom (in general, or of a particular strength), and the communication device 114 is configured to determine the user 110 is within the wagering area 120. In at least one embodiment, when the communication device 114 is within a range of the beacon 122, it is configured to communicate with the wagering hub 102 through the beacon 122, thereby limiting connectivity between the communication device 114 and the wagering hub 102 to the wagering area 120. It should be appreciated that while only one beacon 122 is illustrated in FIG. 1, multiple beacons will often be included in system embodiments to accurately, fully and/or efficiently define the associated wagering areas, when employed to do so. Thereafter in the system 100, the user 110, for example, selects a wagering event identified in the wagering event records, where the event is associated with the wagering area 120. In connection therewith, the user 110 is permitted to, among other things, make wager offer(s) and accept wager offer(s) relating to the event.

To make a wager offer in the system 100, the communication device 114 is configured, by the wagering application 118, to present the wagering criteria for the event to the user 110 (e.g., participants in the event (e.g., by team, player, etc.), wager types (e.g., bet to win, over/under, show, place, exacta, etc.), etc.). In general, the wagers may be consistent in several embodiments, with conventional wagers, but with the user 110 being in control of the odds, or other aspects of the wagers. From the wagering criteria, the user 110 provides a user input(s) to define a wager. For example, the defined wagering criteria may be team A to win by 5 points, wager of $10. It should be appreciated that the offer for the wager may be any different format or amount, specific to the particular event, type of event, odds, spread, etc. For example, in at least one embodiment, the wager amount may be a variable or a range of amounts (e.g., $50-$100, etc.). Regardless, when the user 110 has defined the offer for the wager, a further user input is provided to the wagering application 118 to submit the offer to the wagering hub 102 for publication to the users at the event. In particular, in response, the communication device 114 is configured, by the wagering application 118, to submit a wager packet associated with the defined wager to the wagering hub 102. The wager packet includes, for example, an identifier associated with the user 110 (e.g., a username, a user ID, a device ID for the communication device 114, a phone number, etc.) and the details of the wager offer, and a location of the communication device 114 (e.g., as determined by a GPS network interface 210, etc.), etc. The identifier associated with the user 110 may be provided by the user, or, more likely, the wager will be defined in the application 118 with the user 110 logged into the application 118, and by extension, the user profile associated with the user 110, whereby the user identifier is pulled from the user profile at the time the wager is entered and/or submitted. In one or more embodiments, the user 110 is authenticated to the application 118 and/or the communication device 114 (e.g., via biometrics, a passcode, etc.) prior to entering and/or submitting an offer for a wager to ensure the user 110 is permitted to access the user profile, the application 118 and/or the communication device 114, in order to makes offers for wagers.

Further, in connection with the wagering packet being transmitted to the wagering hub 102, the wagering packet may be encrypted and/or tokenized, in a manner, whereby security of the wager is enhanced and/or the wagering hub 102 is configured to identify the user 110 and/or the communication device 114 submitting the offer for the wager. For example, the communication device 114 and/or the application 118 may be configured to extract various unique device identifier(s) from the communication device 114 (e.g., an integrated circuit card ID, an international mobile equipment identity, a mobile station ISDN number, an international mobile subscriber identity, a media access control (MAC) address, etc.), combined the identifier(s) with payment account information for the user 110 from his/her user profile (e.g., a PAN for the user's payment account, etc.), and tokenize the results to ensure the underlying lying transactions (e.g., the underlying geo-location based transactions, etc.) are legitimate and authentic. In doing so, the different unique device identifiers and/or payment account information may be fed into a 1-way hash (e.g., a SHA-256 hash, etc.) so that the individual unique device identifiers and/or payment account information, when included in and/or transmitted as part of the wagering packet, would be obfuscated and indeterminate. In some embodiments, geo-location data for the communication device 114 may also be included as part of the tokenized data, to ensure that the user 110 is actually at the preapproved event.

It should be appreciated that, after submission of the offer for the wager, the user 110 is permitted to revoke or edit the offer for the wager, generally, in the same manner as described for creating the wager offer, up until the wager offer is accepted by another user (as described below).

Upon receipt of the wager packet from the user 110 (via the communication device 114 and wagering application 118), the wagering hub 102 is configured to append the wagering packet to the event record for the event, as the offer for the wager. Optionally, the wagering hub 102 may be configured to divide wagers of a certain amount and/or type into multiple wagers. For example, when the user 110 offers a wager of $100 for an over/under wager for a football game, the wagering hub 102 may be configured to divide the offer for the wager into four individual offers, each having an amount of $25, or otherwise divide the wager, which may serve to elicit more acceptance of the wager (in parts). The multiple divided offers for wagers may then be appended to the event record.

The wagering hub 102 is configured to then provide the wagering event record, including the offer for the wager, in whole or in part, (or an update thereto) to the communication devices 114 and 116 at one or more regular or irregular intervals during the wagering interval, so that the wager offer from the user 110 (and similar wager offers from other users) may be viewed and/or accepted by other users. The wagering hub 102 may be configured to provide the event record, or update, based on a location of the communication device 116, for example, or in response to a search by the user 112, for example.

For the user 112 to accept the wager offer, for example, the communication device 116 is configured, by the wagering application 118, to access the event record (e.g., upon receipt of the event record from the wagering hub 102, or by retrieving it from the wagering hub 102, etc.). The communication device is configured to then provide an AR experience at the output device 208 of the communication device 116 to the user 112. In this exemplary embodiment, the communication device is configured to provide of a camera view from a camera input device of the communication device 116 to the presentation unit 206 of the communication device 116 (as shown in FIG. 2), render each of the offers as a symbol (e.g., a flag, etc.), and overlay the symbols onto the camera view at a location indicated by the offer (e.g., a location associated with the communication device 114 when the wager was submitted thereby, etc.), when the location is within the camera view. The symbol may include details of the offer for the wager, such as, for example, the amount or range of amounts of the wager, the odds of the wager, a time until an expiration of the offer, an identity of the originating user 110, etc. The user 112 is able to view the offers in the AR experience, and move the communication device 116 to move the camera view to expose additional offers for wagers, and consider the offers for wagers shown in the AR experience. When the user 112 decides to accept the wager offer from the user 110, in this example, the user 112, with the communication device 116, either selects the offer for the wager in the AR experience (e.g., by touching the symbol associated with the offer, etc.), or navigates to the wager offer in the AR experience. In the later, as the user 112 navigates, the communication device 116 is configured, by the wagering application 118, to modify the AR experience to direct and/or permit the user 112 to navigate to the wager offer, whereby the user 112 selects, captures, or otherwise accepts the wager offer.

Upon acceptance of the wager offer by the user 112, the wagering hub 102 is configured to debit funds (or credits) from the account of the user 112 (issued by the issuer 106) in the amount wagered by acceptance of the wager offer, and debit funds (or credits) from the account of the user 110 (issued by the issuer 104) in the amount of the wager payout. The wagering hub 102 is configured to then create a virtual account specific to the wager, and to append the funds to the virtual account. In particular, once the wager is accepted by user 112, a virtual card is created and tied to the wager. Funds from both the user 110 and the user 112 are debited from the respective account (or from credit associated therewith) and added to the new virtual card. In general, a fee associated with the wager is subtracted from the funds added to the virtual card, and provided to an account associated with the wagering hub 102. This fee may be a part of the amount wagered, or an amount in addition to the amount wagered, which, regardless of the type, is agreed to by the users 110 and 112 prior to submitting and/or accepting the wager.

When the offer is accepted, the wagering hub 102 is configured to remove the offer from the event record for the event. This is a change in the event record. Other changes may include additional offers being added to the event record, or revocation of offers by originating users. At one or more regular or irregular intervals, in real time, and/or in response to a change (or threshold number of changes), the wagering hub 102 is configured to transmit an update to the event record, which may include changes to the event record in total, or only changes to the event record since transmitted previously.

Upon completion of the event, for example, the wagering hub 102 is configured to verify a result of the event, and thereby identifying a winner of the wager offer (e.g., with a third party, a historian, an event authority, etc.). Once verified, the wagering hub 102 is configured to distribute the funds, for example, by assigning the virtual account to a virtual wallet associated with the user 110 or the user 112, whoever is the winner, whereby the user 110 or the user 112 is able to use the virtual card to purchase products, through the virtual wallet. It should be appreciated that in various embodiments, the wagering hub 102 may be configured to distribute the funds by transferring the funds from the virtual account to the payment account funding the wager, upon identifying the winner (and thus omit assigning the virtual card to the user's virtual wallet), etc.

It should be appreciated that all offers for wagers and other wagering described herein, whereby the system 100 performs as described, will be in compliance will all applicable laws, regulations and restrictions. In addition, in various exemplary embodiments, the user (e.g., users 110 and 112, etc.) involved in the different transactions herein are prompted to agree to legal terms associated with their payment accounts, for example, during enrollment in their accounts, etc. relating to the transactions described herein. In so doing, the users may voluntarily agree, for example, to allow wagering transactions, etc. and to allow the wagering hub 102, for example, to use data collected during enrollment and/or collected in connection with processing the transactions herein, subsequently for one or more of the different purposes described herein.

FIG. 3 illustrates an exemplary method 300 for use in providing an AR experience to a user to permit the user to wager on an event associated with a wagering area. The exemplary method 300 is described as implemented in the wagering applications 118 in the communication devices 114 and 116 and the wagering hub 102 in the system 100, and further with reference to computing device 200. However, it should be understood that the method 300 is not limited to this configuration of the system 100, as the method 300 may be implemented, at least in part, in other parts in system 100, or in multiple other computing devices or systems. As such, the methods herein should also not be understood to be limited to the exemplary system 100 or the exemplary computing device 200, and likewise, the systems and the computing devices herein should not be understood to be limited to the exemplary method 300.

In FIG. 3, the operations of the method 300 are divided among the wagering hub 102 and the wagering application 118 (and/or communication devices 114 and 116). This is represented by use of dashed boxes for the operations performed by the wagering hub 102, with the other operations then being performed by the wagering application 118. It should be appreciated that the operations may be done otherwise, or by the other of the wagering hub 102 and/or the wagering application 118, in other embodiments.

In the method 300, when the user 112, for example, arrives at the wagering event, or more specifically, the wagering area 120 (or at other times (e.g., upon initiation of the wagering application 118, at intervals thereafter, etc.)), the wagering application 118 determines, at 302, whether the communication device 116 is within the wagering area 120. This may be accomplished in multiple different manners. In one example, the communication device 116 may determine a location of the communication device 116, based on location information captured by a GPS network interface 210 of the communication device 116 as GPS coordinates indicative of a location of the user 112. The communication device 116 may then retrieve, from the wagering hub 102, the wagering area 120, or more specifically, a definition thereof, which is maintained by the wagering hub 102, and compare the location to a definition of the wagering area 120 from the wagering hub 102. When the location is within the definition of the wagering area 120, the communication device 116 determines it is within the wagering area 120. Conversely, if the location is outside of the definition of the wagering area 120, the communication device 116 is not within the wagering area 120. In connection therewith, geo-location data could potentially be used as part of a token generated by the communication device 116 and/or application 118 to ensure that the user 112 is actually at the preapproved event.

Alternatively, in one example, the communication device 116, and in particular, a network interface 210 thereof, view the available wireless networks (e.g., through Bluetooth® pings, router pings, to/from the beacon 122, etc.) to determine if the communication device 116 is within a range of the beacon 122 of the wagering area 120. The determination may further include a comparison of the signal strength included therein to one or more thresholds, whereby the communication device 116 is inside the wagering area 120 when the signal strength of the beacon 122 is above a threshold. That is, in general, the communication device's ability to "see" the beacon 122 (or multiple beacons or devices), or when the signal from the beacon 122 is at a specific signal strength, the communication device 114, and by extension the user 110, is determined to be within the wagering area 120.

In either case, the wagering application 118 then transmits, at 304, a confirmation of the presence of the user 110 and/or the communication device 114 as being within the wagering area 120, including the location information, to the wagering hub 102, via the communication device 116. The confirmation may include a request for the event record associated with the event.

It should be appreciated that in one or more embodiments, the communication device 116 may merely provide a location (or location information), alone or with a search criteria to the wagering hub 102. In response, the wagering hub 102 determines whether the location is within a wagering area 120 for an event, and/or whether the location is within a wagering area for an event indicated by the search criteria.

With continued reference to FIG. 3, in response to the confirmation, the wagering hub 102 provides, at 306, a wagering event record, or part thereof, for the wagering area 120 to the communication device 116 (e.g., based on the confirmation, a location included in the confirmation, or potentially, a search by the user 112; etc.). In turn, the wagering application 118 accesses the event record, at 308. With that said, the wagering hub 102 may provide the event record (or multiple event records) to the wagering application 118 in connection with the determination, at 302, in whole or in part, or in connection with accessing the event record, at 308. In either case, the communication device 116, via the wagering application 118, may access the event record by either retrieving the event record from the wagering hub 102, or receiving the event record from the wagering hub 102 (e.g., when the wagering hub 102 transmits it to the communicating device 116, etc.), etc.

In one exemplary embodiment, consistent with FIG. 3, when the application 118 is active in the communication device 116, the wagering hub 102 may provide the event record(s), or part thereof (e.g., an event name and a definition of the wagering area 120, etc.), so that the communication device 116 compares its current location to the wagering areas for one or more of the events, continuously, or at one or more intervals, whereby the communication device 116 is able to inform the user 112 after entering the wagering area 120. In this manner, once the communication device 116 determines that it is within the wagering area 120, the communication device 116 transmits the confirmation, at 304, and accesses the event record, at 308, whereupon the wagering hub 102 provides the event record, in whole or in part, to the communication device 116. Stated simply, the event record may include multiple parts, with the wagering area 120 being provided, by the wagering hub 102, to the communication device 116 at one time (e.g., prior to step 302, etc.), and then, the offer for wager being provided to the communication device 116, by the wagering hub 102, at a later time (e.g., after step 304, etc.).

The wagering event record may include details of the event, such as, for example, teams, participants, event times, wagering intervals, and/or conditions, etc. Again, in this example, the event may be a football game, whereby the wagering event record may include the teams playing in the football game, the active/inactive players, the wagering interval (e.g., two hours prior to the game and the game itself, etc.), sample wagers (e.g., over/under, etc.), etc. The wagering event record may further include form offers for wagers for the user 112, for example, which may be generally consistent with conventional wagers (e.g., over/under, win/lose, times, orders, etc.). The event record may further include currently published odds associated with the event and/or wagering forms, which are retrieved by the wagering hub 102 though one or more APIs, and which are updated to the communication device 116 at one or more regular or irregular intervals.

After accessing the wagering event record to the user 112, the wagering application 118 then provides an AR experience to the user 112, at 310, through use of the wagering event record and a camera view from a camera input device 208 of the communication device 116. In particular, the communication device 116 provides the AR experience from the camera view at the presentation unit 208 of the communication device 116 to the user 112, and overlaid with one or more symbols on the camera view, which represent one or more of the offers for wager included in the event record. That is, each of the offers in the event record is associated with a location within the wagering area 120, when the camera view encompasses that location, a symbol, representative of the offer for the wager, is overlaid, generally, in that location in the camera view. The location may include, for example, the location of the communication device 116, when the offer for the wager was submitted, etc. As presented in the AR experience, the symbol may include basic information and/or details about the offer for the wager (e.g., wager type, wager conditions, wager amount, etc.).

FIG. 4 illustrates an exemplary AR interface 400, as part of the AR experience, which is presented to the user 112, at the communication device 116. As shown, the AR interface 400 includes a camera view of a football stadium, in the background, which, in this embodiment, is a camera input device view from the communication device 116. As provided by the wagering application 118, three wagers are represented, in the AR interface 400, as symbols. The symbols in this example are flags 402, 404, and 406, which are overlaid on the camera view of the stadium. Each of the symbols includes wager details for the wager offered (e.g., Over 30 pts, Team B to Win, etc.), which include, for example, a dollar amount offered with the wager (e.g., $50, $30, etc.) (or range thereof) and odds defined by the originating user who offers the wager. In addition, each symbol includes a username of the originating user who offered the wager, and a timer, which indicates the pendency (i.e., an expiration) of the offer and/or the time for the user 112 to accept the wager. The timer, in this exemplary embedment, will count down to zero, whereupon the communication device 116 (or application 118) removes the symbol representative of the expired offer for the wager from the AR interface 400.

Further, as shown in FIG. 4, as part of the AR experience, the AR interface 400 also includes a line box 408, which includes the currently published lines and/or odds associated with wager for the event, in general, or specific to the wagers shown in the AR interface 400. It should be appreciated that the AR interface 400 is updated, either consistently, or at one or more intervals, as additional wager packet(s) are received from the wagering hub 102 (e.g., with new wagers, updates to the odds, removed wagers (i.e., when accepted by others, etc.), etc.).

With reference again to FIG. 3, when the user 112 identifies a wager offer he/she would like to accept, the user 112 provides an input to the communication device 116 indicating acceptance of the wager offer. And, the communication device 116, via the wagering application 118, receives the acceptance input, at 312. For example, the wagering application 118 may receive a direct input from the user 112 to accept the wager in the AR experience and/or the wagering application may navigate to the location of the wager indicated in the AR experience. In the former, in FIG. 4, for example, the user 112 may directly select the "Accept" button in the AR interface 400 associated with the wager the user 112 desires to accept. Specifically, where the wager amount is still variable as in the wager 404, the user 112 will be invited to enter an amount in connection with his/her acceptance. As to the later, the user 112 may navigate to the location of the wager 404 in the AR interface 400, for example, and then performs a capture motion with the communication device 116, whereby a capture input is received by the wagering application 118 for the wager offer, at the communication device 116. In either case, upon receipt of the input to accept, the wagering application 118 transmits, at 314, the acceptance to the wagering hub 102, which includes an identification of the wager offer along with an identification of the user 112.

Additionally, or alternatively, the user 112 may select one of the wagers 402-406 in the AR interface 400, whereby the application 118 will cause a different interface to be displayed to the user 112, at the communication device 116, in place of or over the top of the AR interface 400. In connection therewith, FIG. 5 illustrates an exemplary detailed wager interface 500, as part of the AR experience, which is overlaid as a light box on the AR interface 400 and includes details of the selected wager 402. As shown, the detailed wager interface 500 also includes odds offered by Casino_Z (i.e., 1.8:1) for the given event. The detailed wager interface 500 further includes other information related to the wager 402, such as, for example, historical data related to the point totals for prior footballs games involving Team A and Team B. It should be appreciated that any information, either current or historic, that the user 112 might deem helpful or useful, as related to the wager 402, may be included in the detailed wager interface 500 in other embodiments. And, finally, the detailed wager interface 500 includes fields for the user 112 to propose a different amount 502 or different odds 504, for the wager to the user associated with Username_3. From the detailed wager interface 500, the user 112 may thus either accept the wager, or submit a different wager, whereupon a message is issued to the originator of the wager, i.e., the user associated with Username_3. The message includes an identification of a wager and the proposed changes to the wager and also provides an input for the user to accept the proposed changes.

In the meantime, in one or more embodiments, when the user 112 selects the wager 402 via the detailed wager interface 500, an input is provided, by the application 118, back to the wagering hub 102, which indicates the user 112 is viewing the wager. In response, the wagering hub 102 holds the wager in an "off the books" status, whereby other users (apart from the user 112) will be unable dot accept the wager either until the user 112 closes the detailed wager interface 500 (whereupon a notice is provided to the wagering hub 102) or a time interval has lapsed (e.g., one minute, two minutes, etc.).

It should be appreciated that the interfaces 400 and 500 are included herein for purposes of illustration only and that other interfaces, relating to AR or otherwise, may be provided by the application 118 to the user 112, at the communication device 116, in other method embodiments.

Referring again to the method 300 in FIG. 3, in response to acceptance of the wager, the wagering hub 102 debits, at 316, the funds for the wager from the payment account associated with each of the user 112 (as accepting the wager offer) and also the user that originated the wager offer (as described below). And, the funds are added or appended to a virtual account, which is created for the accepted wager. The wagering hub 102, at 318, further removes the wagering offer from the wagering event record for the event, as an open wager offer (and provides the event record to users within the wagering area 120), thereby preventing other users from duplicate capture of the wager offer.

The user 112 may then return to the AR experience and continue to review wager offers, as added to the AR experience through updates to the wagering event record from the wagering hub 102. When the event is concluded, the wagering hub 102 determines an outcome of all accepted wagers. This may be accomplished through verification of the outcome of the event, by the wagering hub 102, with a third party, historian, etc. Then, at 320, the wagering hub 102 distributes funds to the payment account associated with the winning user for the wager offer. The funds may be distributed, by the wagering hub 102, by assigning the virtual account to a virtual wallet associated with a winning user, or by causing the funds included in the virtual account to be transferred to an account either selected by the user or used by the user to fund the wager.

In view of the above, the systems and methods herein permit wagering among users in an AR experience, whereby users are able to offer wagers and also view offers for wagers from other users in a view of the wagering area, in the AR experience. In this manner, the systems and methods provide an AR experience, which offers a user-to-user wagering platform and which provides gamification of the wagering and/or the event, within a wagering area associated with the event, whereby an improved interface to wage offers is provided to make the user's experience more efficient and/or entertaining.

Again and as previously described, it should be appreciated that the functions described herein, in some embodiments, may be described in computer executable instructions stored on a computer readable media, and executable by one or more processors. The computer readable media is a non-transitory computer readable storage medium. By way of example, and without limitation, such computer-readable media can include RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Combinations of the above should also be included within the scope of computer-readable media.

It should also be appreciated that one or more aspects of the present disclosure transform a general-purpose computing device into a special-purpose computing device when configured to perform the functions, methods, and/or processes described herein.

As will be appreciated based on the foregoing specification, the above-described embodiments of the disclosure may be implemented using computer programming or engineering techniques including computer software, firmware, hardware or any combination or subset thereof, wherein the technical effect may be achieved by performing at least one of the following operations: (a) determining, by the computing device, whether the computing device is within a wagering area for an event; (b) when the computing device is within the wagering area, accessing an event record from a wagering hub associated with the event, the event record include an offer for a wager from an originating user within the wagering area; (c) providing, by the computing device, at a presentation unit of the computing device, an augmented reality (AR) experience to a user associated with the computing device, the AR experience including a view from a camera input device of the computing device and a symbol for the offer for the wager included in the event record, the symbol including at least one detail of the wager; and (d) transmitting, by the computing device, an acceptance of the offer for the wager to the wagering hub, based on an input, by the user, directed to the offer in the AR experience, whereby the wager is accepted and funds are collected, by the wagering hub, from accounts associated with the user and the originator user.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When a feature is referred to as being "on," "engaged to," "connected to," "coupled to," "associated with," "included with," or "in communication with" another feature, it may be directly on, engaged, connected, coupled, associated, included, or in communication to or with the other feature, or intervening features may be present. As used herein, the term "and/or" includes any and all combinations of one or more of the associated listed items.

In addition, as used herein, the term product may include a good and/or a service.

Although the terms first, second, third, etc. may be used herein to describe various features, these features should not be limited by these terms. These terms may be only used to distinguish one feature from another. Terms such as "first," "second," and other numerical terms when used herein do not imply a sequence or order unless clearly indicated by the context. Thus, a first feature discussed herein could be termed a second feature without departing from the teachings of the example embodiments.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of exemplary embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A computer-implemented method for use in providing an augmented reality (AR) experience to a user for an event, to permit the user to wager on the event through the AR experience, the method comprising:

determining, by a computing device, whether the computing device is within a wagering area for an event;

in response to the computing device being within the wagering area, accessing an event record from a wagering hub associated with the event, the event record including an offer for a wager from an originating user within the wagering area;

providing, by the computing device, at a presentation unit of the computing device, an AR experience to a user associated with the computing device, the AR experience including a view from a camera input device of the computing device and a symbol for the offer for the wager included in the view from the camera input device at a location associated with the offer represented by the symbol, as defined by a location of a computing device identified to the originating user, the symbol including at least one detail of the wager; and transmitting, by the computing device, an acceptance of the offer for the wager to the wagering hub, based on an input, by the user, directed to the offer in the AR experience, whereby the wager is accepted and funds associated with the wager are collected, by the wagering hub, from accounts associated with the user and the originator user.

2. The method of claim 1, wherein determining whether the computing device is within the wagering area includes:

determining a GPS location of the computing device, by a GPS network interface included in the computing device; and comparing, by the computing device, the location of the computing device to a definition of the wagering area from the wagering hub.

3. The method of claim 1, wherein determining whether the computing device is within the wagering area includes determining, by the computing device, whether the computing device is within a wireless range of at least one beacon located at the wagering area.

4. The method of claim 3, wherein the event includes a sporting event and wherein the wagering area includes a facility structure associated with sporting event.

5. The method of claim 1, wherein accessing the event record includes retrieving the event record from the wagering hub based on a location of the computing device and/or a search for the event by the computing device.

6. The method of claim 1, wherein the event record includes multiple offers for wagers, each associated with an originating user; and wherein providing the AR experience includes overlaying multiple symbols into the view from the camera input device, where each symbol is overlaid when a location associated with the offer represented by the symbol, as defined by a computing device identified to the originating user, is within the view.

7. The method of claim 1, wherein the symbol includes a flag associated with a location of the originating user, the flag including an amount of the wager, odds for the wager, and an identifier associated with the originating user; and wherein the input by the user directed to the offer includes a selection of the flag.

8. The method of claim 7, wherein the symbol further includes a timer indicative of an expiration time for the offer represented by the symbol; and wherein the method further comprises removing the symbol from the AR experience when the timer expires.

9. The method of claim 1, further comprising:

debiting, by the wagering hub, the funds from the account associated with the user and the account associated with the originating user;

appending, by the wagering hub, the funds to a virtual account specific to the wager; and distributing the funds to a winner of the wager from one of the user and the originating user after the event.

10. A system for use in providing augmented reality (AR) experiences to users associated with an event, to permit wagering by the users, the system comprising:

a wagering hub including a memory, the memory including an event record specific to an event and including one or more offers submitted by originating users at the event for a wager, the wagering hub configured to transmit the event record to a portable communication device associated with a user; and a non-transitory computer readable storage media including executable instructions, which when executed by a processor of the portable communication device, cause the portable communication device to:

determine whether the portable communication device is within a wagering area associated with the event;

access the event record for the event from the wagering hub in response to the portable communication device being within the wagering area;

provide an AR experience to a user of the portable communication device, the AR experience including a camera view from an input device of the portable communication device and a symbol for each of the one or more offers associated with the event record included in the camera view, wherein a location of each symbol in the camera view is based on a location of a computing device associated with an originating user for each of the one or more offers; and transmit an acceptance of one of the one or more offers to the wagering hub, based on a user input to the symbol included in the AR experience and associated with said accepted offer; and wherein the wagering hub is configured to:

receive the acceptance from the portable communication device;

after receiving the acceptance, debit funds from a payment account associated with the user for the accepted offer and funds from a second payment account associated with the originating user for the accepted offer, and append the funds to a virtual account; and distribute the funds to a winner from the originating user and the user based on an outcome of the event and the accepted offer.

11. The system of claim 10, wherein the wagering hub is configured to transmit the event record to the portable communication device based on a location of the portable communication device.

12. The system of claim 10, wherein the wagering hub is configured to transmit the event record to the portable communication device based on a search from the portable communication device.

13. The system of claim 10, wherein the wagering hub is configured to transmit an update for the event record to the portable communication device after a change to the event record, the change including one of an additional offer for a wager and revocation of one of the one or more offers.

14. The system of claim 10, further comprising the portable communication device.

15. A non-transitory computer-readable storage medium including executable instructions for use in providing augmented reality (AR) experiences to users associated with an event, which when executed by a processor of a portable communication device, cause the portable communication device to:

determine whether the portable communication device is within a wagering area associated with the event;

in response to the portable communication device being within the wagering area, access an event record from a wagering hub associated with the event, the event record including an offer for a wager from an originating user within the wagering area;

provide, at a presentation unit of the portable communication device, an AR experience to a user of the portable communication device, the AR experience including a view from a camera input device of the portable communication device and a symbol for the offer for the wager included in the view at a location associated with the offer represented by the symbol, as defined by a location of a computing device identified to the originating user, when the location of the computing device identified to the originating user is within the view; and transmit an acceptance of the offer for the wager to the wagering hub, based on an input, by the user, directed to the offer in the AR experience, whereby the wager is accepted and funds associated with the wager are collected, by the wagering hub, from accounts associated with the user and the originator user.

16. The non-transitory computer-readable storage medium of claim 15, wherein the executable instructions, when executed by the processor of the portable communication device, further cause the portable communication device to determine whether the computing device is within the wagering area based on the portable computing device being within a wireless range of at least one beacon located at the wagering area.

17. The non-transitory computer-readable storage medium of claim 15, wherein the executable instructions, when executed by the processor of the portable communication device, further cause the portable communication device to access the event record based on a location of the portable computing device.

18. The non-transitory computer-readable storage medium of claim 15, wherein the event includes a sporting event and wherein the wagering area includes a facility structure associated with sporting event; and wherein the symbol includes a flag associated with a location of the originating user, the flag including an amount of the wager, odds for the wager, and an identifier associated with the originating user.

19. The non-transitory computer-readable storage medium of claim 15, wherein the symbol includes a timer indicative of an expiration time for the offer represented by the symbol; and wherein the executable instructions, when executed by the processor of the portable communication device, further cause the portable communication device to remove the symbol from the AR experience when the timer expires.

20. The non-transitory computer-readable storage medium of claim 15, wherein the event record includes multiple offers for wagers, each associated with an originating user; and wherein the executable instructions, when executed by the processor of the portable communication device, further cause the portable communication device to provide the AR experience with a symbol representing each of the multiple offers in the view from the camera input device, when a location associated with said offer represented by said symbol, as defined by a location of a computing device identified to the originating user associated with said offer, is within the view.

* * * * *